US010986889B2

(12) United States Patent
Guer

(10) Patent No.: US 10,986,889 B2
(45) Date of Patent: Apr. 27, 2021

(54) SPORTS SHOE WITH STUDS

(71) Applicant: Jean Luc Guer, Marseilles (FR)

(72) Inventor: Jean Luc Guer, Marseilles (FR)

( * ) Notice: Subject to any disclaimer, the term of this patent is extended or adjusted under 35 U.S.C. 154(b) by 150 days.

(21) Appl. No.: 15/366,743

(22) Filed: Dec. 1, 2016

(65) Prior Publication Data

US 2017/0143072 A1 May 25, 2017

Related U.S. Application Data

(62) Division of application No. 13/322,828, filed as application No. PCT/EP2010/057564 on May 31, 2010, now abandoned.

(30) Foreign Application Priority Data

May 29, 2009 (FR) ..... 0953606

(51) Int. Cl.

| | |
|---|---|
| ***A43B 5/02*** | (2006.01) |
| ***A43C 15/16*** | (2006.01) |
| ***A43B 21/52*** | (2006.01) |
| ***A43B 7/16*** | (2006.01) |
| ***A43C 15/02*** | (2006.01) |

(52) U.S. Cl.

CPC ..... *A43B 5/02* (2013.01); *A43B 7/16* (2013.01); *A43B 21/52* (2013.01); *A43C 15/02* (2013.01); *A43C 15/161* (2013.01); *A43C 15/165* (2013.01); *A43C 15/167* (2013.01)

(58) Field of Classification Search

CPC .. A43B 5/02; A43B 21/52; A43B 7/16; A43C 15/167; A43C 15/165; A43C 15/161; A43C 15/02

See application file for complete search history.

(56) References Cited

U.S. PATENT DOCUMENTS

| | | | | | |
|---|---|---|---|---|---|
| 931,343 | A * | 8/1909 | Riley | A43B 7/00 | 36/134 |
| 1,515,330 | A * | 11/1924 | Bell | A43C 13/04 | 36/66 |
| 2,177,156 | A * | 10/1939 | Shapiro | A43B 5/02 | 36/134 |
| 2,292,299 | A * | 8/1942 | Smith | A43C 15/161 | 36/59 R |

(Continued)

FOREIGN PATENT DOCUMENTS

| | | |
|---|---|---|
| BE | 808547 A2 | 3/1974 |
| GB | 1 423 881 | 2/1976 |

(Continued)

OTHER PUBLICATIONS

International Search Report as issued for PCT/EP2010/057564.

*Primary Examiner* — Katharine G Kane

(74) *Attorney, Agent, or Firm* — Pillsbury Winthrop Shaw Pittman LLP

(57) ABSTRACT

A sports shoe includes an instep and a rigid outer sole, the sole having a front portion including a first plurality of studs, a central portion, and a rear portion including a second plurality of studs. The rear portion includes a thickened portion with a flat outer surface on which the second plurality of studs is located, the thickened portion raising the rear portion relative to the front portion; the central portion includes an inwardly curved outer profile.

9 Claims, 6 Drawing Sheets

(56) References Cited

U.S. PATENT DOCUMENTS 2,395,218 A * 2/1946 Gauthier ..... A43B 13/37 162/141
2,403,442 A * 7/1946 Klaus ..... A43B 7/142 36/87
2,904,903 A * 9/1959 Kardon ..... A43B 5/02 36/128
3,025,615 A * 3/1962 Patton ..... A43C 15/165 36/7.6
3,181,254 A 5/1965 Cowen
3,271,885 A 9/1966 McAuliffe
3,273,266 A * 9/1966 Goldenberg ..... A43B 5/02 36/108
3,638,337 A * 2/1972 Dollar, Jr. ..... A43C 15/165 36/67 R
4,294,024 A * 10/1981 Nab ..... A43C 15/165 36/113
4,367,600 A 1/1983 Cross et al.
4,454,662 A * 6/1984 Stubblefield ..... A43B 5/00 36/102
4,510,702 A * 4/1985 Ehrlich, Jr. ..... A43B 13/04 36/103
4,667,425 A 5/1987 Effler
4,782,604 A * 11/1988 Wen-Shown ..... A43B 5/001 36/127
4,885,851 A * 12/1989 Peterson ..... A43B 3/0094 36/127
5,025,574 A 6/1991 Lasher, III
5,255,453 A * 10/1993 Weiss ..... A43C 15/164 36/128
5,319,866 A * 6/1994 Foley ..... A43B 5/00 36/103
5,615,497 A * 4/1997 Meschan ..... A43B 3/0042 36/100
D397,850 S * 9/1998 Harada ..... D2/959
5,932,336 A * 8/1999 Allen ..... A43B 5/001 36/28
5,987,783 A 11/1999 Allen et al.
6,161,315 A * 12/2000 Dalton ..... A43B 5/001 36/134
6,167,641 B1 * 1/2001 McMullin ..... A43C 15/162 36/127
6,289,611 B1 * 9/2001 Patterson ..... A43B 5/001 36/127
6,519,874 B1 * 2/2003 Dean ..... A43B 7/1415 36/30 R
6,892,479 B2 * 5/2005 Auger ..... A43B 5/02 36/128
2002/0062578 A1 * 5/2002 Lussier ..... A43B 5/02 36/59 R
2002/0088147 A1 7/2002 J00 et al.
2003/0154629 A1 * 8/2003 Goodloe ..... A43B 3/24 36/42
2004/0000074 A1 * 1/2004 Auger ..... A43B 5/02 36/102
2006/0075662 A1 4/2006 Schupbach
2007/0017125 A1 * 1/2007 Jennings ..... A43B 5/02 36/67 A
2007/0199211 A1 8/2007 Campbell
2008/0196272 A1 * 8/2008 Hay ..... A43B 7/1415 36/88
2008/0196274 A1 * 8/2008 Gerber ..... A43B 13/36 36/100
2009/0249648 A1 * 10/2009 Brown ..... A43B 5/001 36/91

FOREIGN PATENT DOCUMENTS

| | | |
|---|---|---|
| JP | 60-121806 | 6/1985 |
| JP | 60 121806 U | 8/1985 |
| WO | WO 95/05099 | 2/1995 |
| WO | WO 2008/109651 | 9/2008 |
| WO | WO 2009/002173 | 12/2008 |

* cited by examiner

SPORTS SHOE WITH STUDS

CROSS REFERENCE TO RELATED APPLICATIONS

This application is a divisional of U.S. patent application Ser. No. 13/322,828, filed on May 21, 2012, which is the U.S. National Stage of PCT/EP2010/057564, filed May 31, 2010, which in turn claims priority to French Patent Application No. 0953606, filed May 29, 2009, the entire contents of all applications are incorporated herein by reference in their entireties.

The present invention relates to a sports shoe with studs comprising a rigid sole notably for playing soccer, rugby or other sports.

For sports players and especially for soccer players, the foot is an essential asset when playing sports. Two soccer players may be differentiated by the quality of their passes or kicks, technique being likely to be more important in one than in the other.

From this perspective of improving player performance, manufacturers have developed shoes enabling, for example, ball feel, ball strike quality or else stability by adequate ground/shoe grip to be influenced and/or improved.

Expansion of the economic environment and ongoing research in view of new levels of performance for the sports player, particularly for the soccer player, require the player to increase the frequency and intensity of training and matches, i.e., an increase in the distances covered per match and per week.

Paradoxically, shoes with studs, particularly for playing soccer, have not changed much over these last few years in response to new requirements in the distances covered by the players.

In comparison, shoes utilized in other sports disciplines and particularly in disciplines in which great distances are covered, such as running or basketball, have seen constant changes to meet the expectations of sports players.

As an illustration, in the case of running, many shoe models enable the expectations of each runner to be specifically met and enable training and/or long-distance races to be performed with less physical fatigue. Therefore, supination shoes, pronation shoes, training shoes with a stronger sole, very light shoes for competing, etc., may be found.

In this context, the invention aims to provide a sports shoe with studs providing adequate engagement with the long distances covered by the sports player during training and matches in order to relieve and/or preserve his health.

For this purpose, the invention proposes a sports shoe comprising an instep and a rigid outer sole, said sole presenting:

- a front portion comprising a first plurality of studs;
- a central portion;
- a rear portion comprising a second plurality of studs;

said shoe being characterized in that:

- said rear portion comprises a thickened portion presenting a flat outer surface on which said second plurality of studs is located, said thickened portion raising said rear portion with relation to said front portion; and in that
- said central portion comprises a curved outer profile.

Raising is understood to refer to a modification in the height of a first plane with relation to a second plane substantially parallel to the first plane and tangent to the front portion of the shoe.

The invention therefore proposes a sports shoe with studs, particularly for playing soccer, rugby or other sports, ensuring a posterior raising of the heel of the shoe, enabling insidious and recurring mechanical pathologies in the sports player due to current requirements to be reduced.

In fact, the shoe according to the invention reduces the functional overload of the posterior muscle chain and particularly of the extensor system for better distribution of the load of the foot in the shoe, therefore limiting muscle tension and injury to the dependent muscles, tendons, ligaments and joints.

In fact, this functional disequilibrium of the extensor system promotes, in the sports player, the regular onset of mechanical articular, muscular, tendinous, aponeurotic or else ligamentary pathologies at the level of the foot, knee, lower limbs, pelvis and back.

The posterior difference in level of the shoe enables the foot/shoe assembly to be harmonized by considerably improving the work of the extensor system. Thanks to the invention, the foot performs functional work in synergy between the posterior drive chain and the dependent crossed and anterior muscle chains.

The longitudinal curvature of the shoe resulting from the posterior difference in level enables the longitudinal arches of the foot to be reliably covered. This central curvature promotes the proprioceptive stability of the arches of the foot and elastic cushioning of the mid-foot.

Therefore, the sports shoe according to the invention reduces the onset of all of these pathologies by:

- improving the static positioning of the sports player in a reference position that is physiologically the most neutral possible position;
- rebalancing the ongoing traction work of the extensor system, reducing physical fatigue;
- optimizing the rebalancing of all postural and static problems;
- reducing the overload of the posterior chain by harmonizing the muscle work on all the muscle chains;
- improving muscle yield and corresponding muscle performance by limiting the risk of injury.

In addition to the principal characteristics that have just been mentioned in the previous paragraph, the sports shoe with studs according to the invention may comprise one or more of the characteristics below, considered individually or according to all technically feasible combinations:

- said central portion comprises an arch-shaped curved inner profile, said inner profile being able to follow the shape of the longitudinal arch of the mid-foot;
- the curve of said inner profile of said central portion varies along the transverse axis of the shoe;
- said inner profile of said sole presents an internal profile and an external profile forming a transverse arch, said internal profile comprising greater arching than said external profile;
- said outer profile of said central portion forms the outer longitudinal curvature of said shoe;
- said central portion is an elastic portion able to be deformed to cushion said foot;
- said thickened portion is between 1 and 25 mm;
- said thickened portion is between 10 and 15 mm;
- said thickened portion of said posterior portion extends in said central portion to reinforce the rear portion of said central portion;
- said thickened portion extending in said central portion comprises a beveled portion along a convex profile;
- said thickened portion is formed by a removable riser;
- said outer sole comprises means to form an integral connection with said removable riser;

said studs are removable studs screwed onto said outer sole so as to form an integral connection with said removable riser;

said studs are molded studs or screwed studs forming an integral connection with said removable riser;

said thickened portion forms an integral connection with the rear portion of said outer sole;

said studs are studs molded onto said outer sole.

Another object of the present invention is a removable riser characterized in that the riser comprises an upper surface able to cooperate with the outer surface of the outer sole of a sports shoe according to the invention.

Another object of the present invention is a sports shoe comprising an instep and a rigid outer sole, said sole presenting:

a front portion comprising a first plurality of studs;

a central portion;

a rear portion comprising a second plurality of studs;

Said shoe being characterized in that said rear portion comprises a thickened portion presenting a flat outer surface on which said second plurality of studs is located, said thickened portion raising said rear portion with relation to said front portion, said thickened portion being formed by a removable riser.

The invention thus proposes a sports shoe with studs, particularly for playing soccer, rugby or other sports, ensuring a posterior raising of the heel of the shoe by means of a removable riser that may be simply and quickly replaced. The posterior raising created by the removable riser enables the insidious and recurrent mechanical pathologies in the sports player due to current requirements to be reduced.

The removable aspect of the riser also enables the type of riser to be quickly and easily interchanged in view of contributing a new technical characteristic to the shoe either by placing a riser constituted of a material with a different density or else by modifying the height of the riser. Thus, the rapid interchangeability of the riser enables the mechanical properties of the shoe to be simply modified by proposing a changeable and perfectible sports shoe with studs that is able to adapt to the various technical, mechanical and anatomical requirements of sports players.

In addition to the principal characteristics that have just been mentioned in the previous paragraph, the sports shoe with studs according to the invention may comprise one or more of the characteristics below, considered individually or according to all technically feasible combinations:

said studs are removable studs screwed onto said outer sole and/or onto said removable riser;

said studs are molded studs forming an integral connection with said removable riser;

said thickened portion is between 1 and 25 mm;

said thickened portion is between 10 and 15 mm;

said central portion comprises a curved outer profile;

said outer profile of said central portion forms the outer longitudinal curvature of said shoe;

said central portion comprises a curved inner profile able to follow the shape of the longitudinal arch of the foot;

the curve of said inner profile of said central portion varies along the transverse axis of the shoe;

said inner profile of said sole presents an internal profile and an external profile forming a transverse arch, said inner profile comprising a greater arching than said outer profile;

said thickened portion of said posterior portion extends in said central portion to reinforce the rear portion of said central portion;

said thickened portion extending in said central portion comprises a beveled portion along a convex profile;

said central portion is an elastic portion able to be deformed to cushion said foot.

Another object of the present invention is a removable riser characterized in that the riser comprises an upper surface able to cooperate with the outer surface of the outer sole of a sports shoe according to the invention.

Other characteristics and advantages of the invention will more clearly emerge from the description given below, for indicative and in no way limiting purposes, with reference to the attached figures, among which:

In all figures, common elements bear the same reference numbers.

Figure 1:
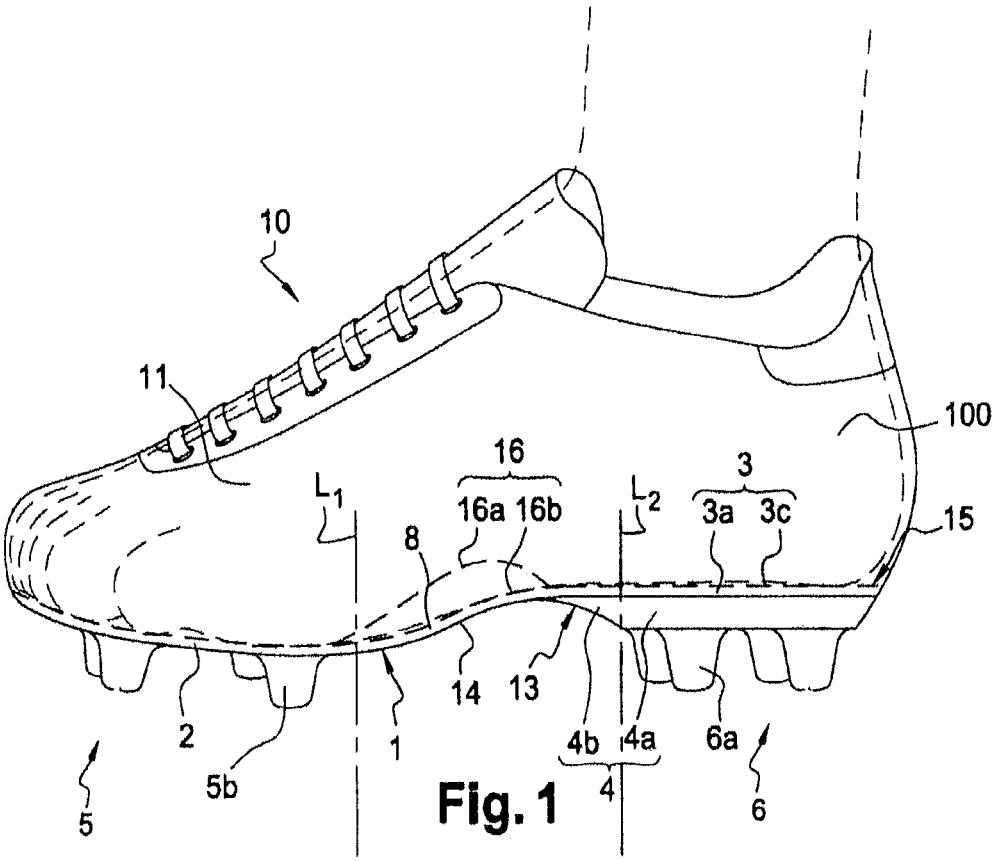
FIG. 1 represents an outer side view of a first embodiment of a sports shoe with studs according to the invention.
Figure 2:
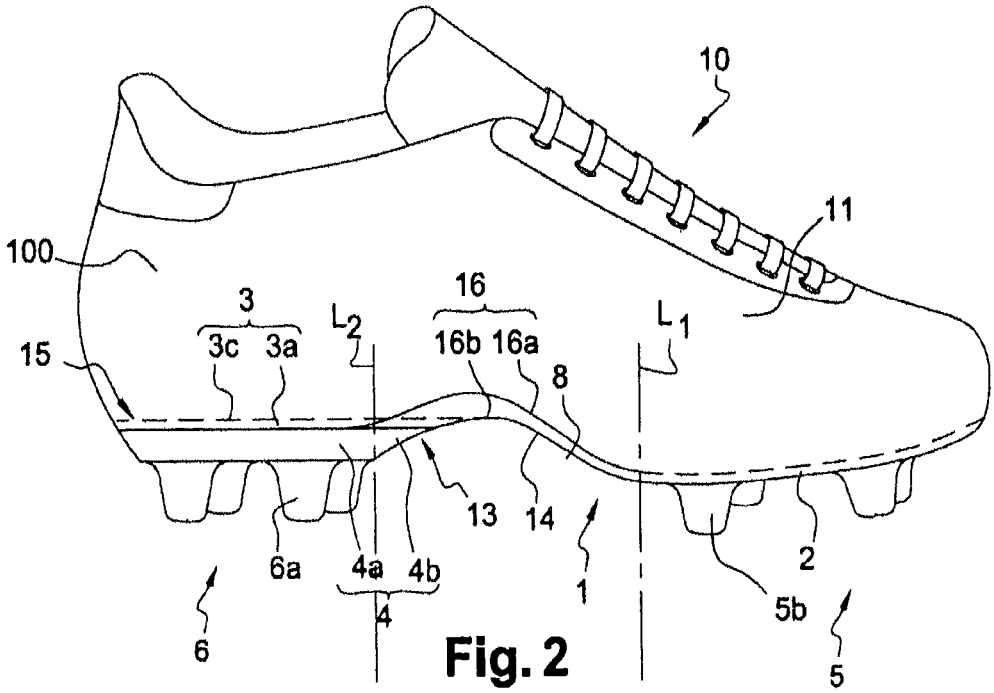
FIG. 2 represents an internal side view of the shoe from FIG. 1.

Shoe 10, in conformance with the first embodiment of the invention and illustrated in particular in FIGS. 1 and 2, comprises a rigid outer sole 1 extending from the front to the rear of the shoe 10 and forming an integral connection with an instep 11.

Rigid sole is understood to refer to a sole that, in contrast to a flexible sole, typically a sole for a running shoe, does not accompany the folding movement from the forefoot to the toes when walking or running.

In a known manner, the instep 11 is able to receive and overlap the entire foot 100. The instep 11 is made by means of several flexible pieces of leather, cloth or any other synthetic material known to the person skilled in the art.

The outer sole 1 comprises three distinct parts, each fulfilling a role in maintaining and positioning the foot 100 in the shoe:

a first portion 2 situated in the front supporting the forefoot, subsequently called the front portion 2;

a second portion 3 situated at the rear supporting the heel, subsequently called the rear portion 3, and;

a third central portion 8 for supporting the mid-foot.

Each portion is defined and sized in order to form an overall plantar profile 15 proposing the most natural possible foot support 100, therefore preserving the anatomical and biomechanical balance of the sports player.

The outer sole 1 comprises a plurality of studs 5 and 6 respectively distributed on the front portion 2 and rear portion 3 of the outer sole 1. Preferentially, the rear portion 3 comprises four studs 6, and the front portion 2 comprises at least four studs 5.

In general, a stud is defined as an element, generally a protuberance, lining the sole of some types of sports shoes in order to ensure better adhesion with the ground, and particularly with soft or grassy ground.

Therefore, stud is also considered to be different elements known to the person skilled in the art ensuring better adhesion with the ground, in particular known by various names: bar, blade, etc.

In this first embodiment of the invention, studs 5 and 6 are known as "molded" studs and thus form an integral connection with outer sole 1 and are produced when outer sole 1 is molded.

In a variation, these studs may be screwed studs in a plastic or metallic material.

Studs 5 and 6 are either of conical, cylindrical or blade shape or any other shape ensuring adhesion with the ground.

The outer sole 1 assembly, here including molded studs 5 and 6, is made in a thermoplastic type plastic material or else in a thermohardening material, possibly reinforced by nylon, glass or carbon type fibers, the outer sole may be an overmolding or an assembly of several materials in order to obtain different mechanical properties at different locations on the sole 1.

Front portion 2 is defined as the portion of the sole extending from the front of the shoe to the straight line L1 represented in dots in FIGS. 1 and 2, substantially corresponding to the position of studs 5*b*, the rear-most studs of the plurality of studs 5.

The rear portion 3 extends from straight line L2 represented in dots in these same FIGS. 1 and 2, substantially corresponding to the position of studs 6*a*, the most forward of the plurality of studs 6 to the rear of the shoe.

Central portion 8 is the portion extending between front portion 2 and rear portion 3, i.e., between straight lines L1 and L2.

Front portion 2 is a portion with low thickness, i.e. a thickness of some millimeters (mm), preferentially less than 10 mm, with a constant and substantially flat thickness. Front portion 2 may comprise, from the origin, a slight bending raising the front of front portion 2 with relation to the rear of front portion 2 so as to arrange maximum support with the ground during the digitigrade phase, i.e. the period when walking or running when the foot support is above the forefoot.

Front portion 2 is the portion of sole 1 supporting the forefoot and more precisely the anterior transverse arch and the anterior supports essentially formed by the head of the first metatarsal and the plantar face of the big toe.

Rear portion 3 of the outer sole 1 is formed by a rigid upper shell 3*a* in contact with the instep 11 and by a riser 4 at the lower portion in contact with the ground, riser 4 comprising a first flat portion 4*a* at the level of the rear portion 3 and a second portion 4*b* extending into the central portion 8 of sole 1.

Upper shell 3*a* comprises a thickness that is substantially constant and substantially equivalent to the thickness of the front portion 2. This upper shell 3*a* is made in a plastic material, preferably rigid and of the thermoplastic or thermohardening type, possibly reinforced by nylon, glass or other type fibers, and forms a flat support at the level of its upper face 3*c*.

Figure 3:
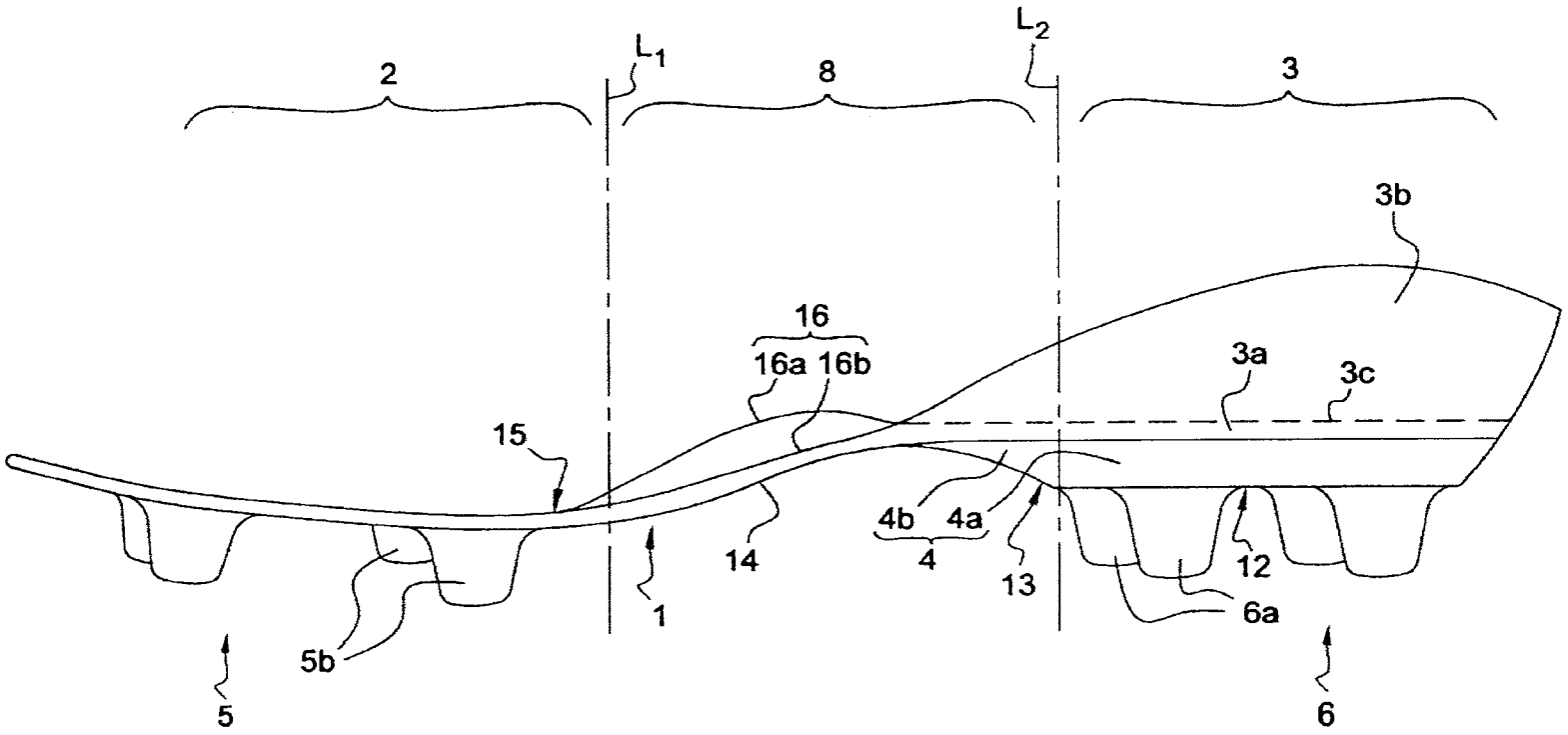
FIG. 3 represents an external side view of an outer sole of a sports shoe according to a variation of the first embodiment.

According to a variation of this first embodiment illustrated in FIG. 3, the upper shell 3*a* may also extend laterally so as to form an enveloping shell 3*b* to optimize the maintenance and rigidity of shoe 10.

In general, in this first embodiment represented in FIGS. 1, 2 and 3, riser 4 is overmolded onto the upper shell 3*a*. Riser 4 is preferentially a visible outer overmolding, whose thickness is constant along rear portion 3, the thickness may be between 1 and 25 mm. Preferably, riser 4 will have a thickness of between 10 and 15 mm in order to sufficiently raise the rear portion with relation to the front portion 2.

Riser 4 substantially has the shape of a solid heel piece, i.e., a heel piece without any external recesses, at least in its front portion 4*b* and comprises a flat outer surface 12, this surface 12 enabling a stable support of the heel when in contact with the ground when studs 5 and 6 are inserted in the ground.

The riser 4 extends, in its portion 4*b*, into central portion 8 of sole 1. In this central portion 8, the thickness of riser 4 is beveled along a substantially convex profile 13 such that riser 4 maintains and reinforces the rear portion of the central portion 8, thus reconditioning the configuration of the mid-foot supports.

Portion 4*b* of the riser enables this area of the central portion 8 to be reinforced by providing additional support in the mid-foot support.

Central portion 8 of sole 1 presents an outer surface profile 14 (i.e.: the outer plantar face) that is curved and arch shaped that forms the outer longitudinal curvature of the shoe. This outer longitudinal curvature is accentuated by the difference in level created by riser 4 in the rear portion 3. Profile 13 of portion 4*b* of riser 4 also accentuates this arch-shaped curvature of the outer profile 14 of central portion 8 of sole 1.

Central portion 8 of sole 1 presents an inner surface profile 16 (i.e.: the inner plantar face) that is also curved and arch shaped that forms the inner longitudinal curvature of the shoe.

The curvature of the inner surface profile 16 varies along the transverse axis of the shoe in order to follow the shape of the mid-foot longitudinal arch and to adequately support it.

Thus, internal profile 16*a* of this inner surface profile 16 presents greater arching than its external profile 16*b* while the internal arch of the mid-foot comprises greater arching than that of its external arch.

Riser 4 is typically made of a polymer material determined by the manufacturer for the purpose of providing an additional characteristic to the sports shoe 10. Riser 4 may be formed by overmolding a mixture of several materials in order to provide different properties to the outer sole 1. Therefore, riser 4 both raises in an isolated manner the rear portion 3 with relation to the front portion 2 but also provides, by strategically and cleverly choosing a material or mix of materials, additional properties of stability, cushioning, shock wave and/or vibration absorption or else properties of elasticity or return.

Therefore for example, riser 4 may be made of a slightly flexible and deformable material, such as a reticulated foam, so as to procure a cushioning function to shoe 1. The riser may also comprise air bubbles and/or springs in order to further improve this cushioning function.

Central portion 8 may also be made of a material different from front portion 2 and upper shell 3*a* of rear portion 3 in order to provide an additional technical characteristic to the sports shoe, such as for example better stability, particularly in torsion, between front portion 2 and rear portion 3 by the utilization of a plastic material that is more rigid than the material of the outer sole 1 or by adding an intermediate shell or an additional tongue, increasing the lateral rigidity of the assembly.

Therefore, such a shoe comprising a rear raising isolated on the rear of the outer sole (i.e., not continuous over the entire length of the shoe) controlling a natural curvature effect of the shoe, does not present the disadvantages inherent to shoes with thick soles (i.e., also filling in the mid-foot) in which said sole limits the proprioceptive role of the foot and needlessly weighs down the shoe.

This natural curvature here is accentuated by the particular shape of the central portion and by that of the riser whose arrangement enables both an inner profile proposing a curvature positioning the foot in a natural position and an outer profile in the shape of an arch providing cushioning and static and dynamic support to the mid-foot.

The internal and external longitudinal curvatures enable the longitudinal arches of the foot to be better contained and enveloped, thus increasing the bearing surface of the plantar supports, limiting the fatigability of the sports player. The loads and pressures on the foot are then better distributed, thus improving, when walking and/or running:

- the transmission of forces and loads from the hindfoot to the mid-foot by limiting tension stresses on the entire posterior muscle chain,
- flexible cushioning and return of the weight transmitted by the tibia to the forefoot, thus facilitating rapid accelerations and starts.

Therefore, the particular curvature of the central portion, particularly created by the riser, preserves the biomechanical activity of the arches of the mid-foot in order to optimize the physiological qualities of the foot in its entirety, i.e., stability, absorption, elasticity, propulsion and drainage.

The outer positioning of the riser ensures a true posterior raising of the heel of the shoe, creating a difference in level between the rear portion and the front portion without modifying the inner volume of the instep and without weighing down the shoe.

This outer positioning also reconditions the location of the shod foot in a more harmonious and more physiological posture by allowing the foot to naturally find the best supported and best enveloped internal and external longitudinal arches. The raising isolated in the rear portion reinforces the grip with the ground initially intended by shoes with studs, particularly in terms of support and acceleration.

In addition, the posterior riser is solid (i.e., it does not comprise any openings or outer recesses), and its outer surface, capable of being in contact with the ground when the studs are pushed into the ground, is flat over the entire rear portion of the shoe.

Thus, this sports shoe enables a stable posterior support and effective and homogeneous raising over the rear portion when the studs are pushed into soft ground. The shoe is thus differentiated from existing sports shoes, and notably from those comprising additions of material isolated at the level of each posterior stud that offer insecure posterior support caused by sinking of the raised isolated portions of the studs. In fact, on soft ground, the soil tends to fill in all of the recesses found between the posterior studs, creating an ineffective raising of the heel and an unstable support.

Figure 6:
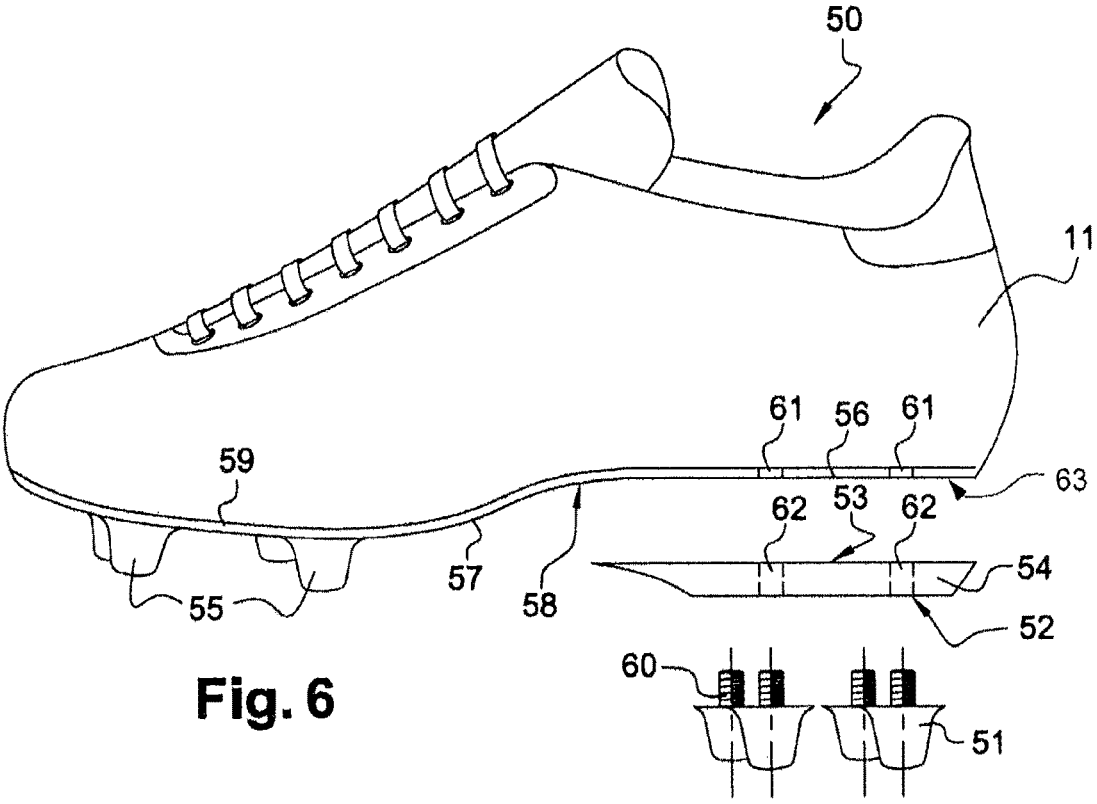
FIG. 6 represents an external side view of a second embodiment of a sports shoe with studs according to the invention.
Figure 4:
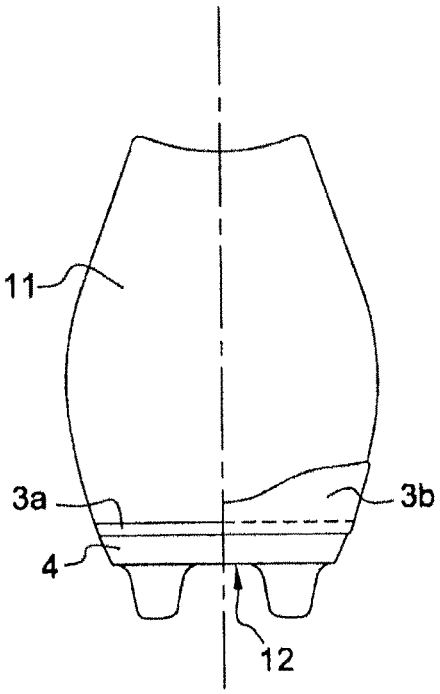
FIG. 4 represents in its left portion, a rear view of the shoe illustrated in FIGS. 1 and 2, and in its right portion, a rear view of the shoe illustrated in FIG. 3.
Figure 5:
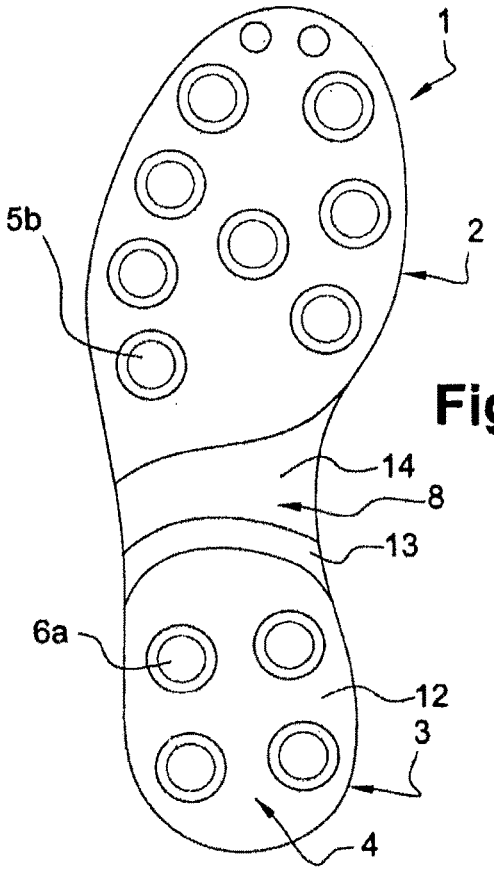
FIG. 5 represents an underside view of a sports shoe in conformance with FIG. 1, 2 or 3.

FIG. 6 represents a sports shoe 50 in conformance with a second embodiment of the invention.

Shoe 50 comprises, unless otherwise stated, all the characteristics of sports shoe 10 described above.

In this shoe 50, unlike shoe 10, riser 54 of the rear portion 56 of the outer sole 58 is removable.

This removable riser 54 comprises an upper surface 53 capable of cooperating with the outer surface 63 of outer sole 58.

Riser 54 also comprises a flat outer surface 52, this surface 52 enabling a stable support of the heel during contact 20 with the ground when studs 51 and 55 are inserted into the ground. Riser 54 forms an integral connection with outer sole 58 by screwing of the posterior studs 51 that each comprise a screwed rod 60.

Screwed rods 60 traverse the corresponding bores 62 disposed in riser 54 and are screwed inside threaded bores 61 disposed in the outer sole 58.

Screwed rods 60 are sized so as to be able to maintain riser 54 in compression between studs 51 and outer sole 58 when these studs 51 are screwed onto this outer sole 58.

The length of the screwed rods 60 of studs 51 is of course a function of the thickness of the riser 54 used.

According to a first variation that is not represented, the bores inserted into the outer sole 58 are preconfigured so as to be able to receive, regardless of the thickness of the riser 54 used, the same screwed rods 60.

According to a second variation that is not represented, screwed rods 60 are screwed both inside riser 54 by means of threaded bores and inside threaded bores 61 disposed in outer sole 58.

According to a third variation that is not represented, studs 51 are either screwed into riser 54 or thermobonded to riser 54. The removable riser 54 forms an integral connection with other engaging means able to receive and form an integral connection with removable riser 54 on the outer sole 58 of the shoe.

By way of example, riser 54 will be placed on and form an integral connection with outer sole 58 by screwing, clipage, interlocking, socketing, lateral or longitudinal sliding or by any other type of equivalent means enabling a removable riser to be simply and rapidly connected/disconnected to or from an outer sole of a shoe.

Figure 8:
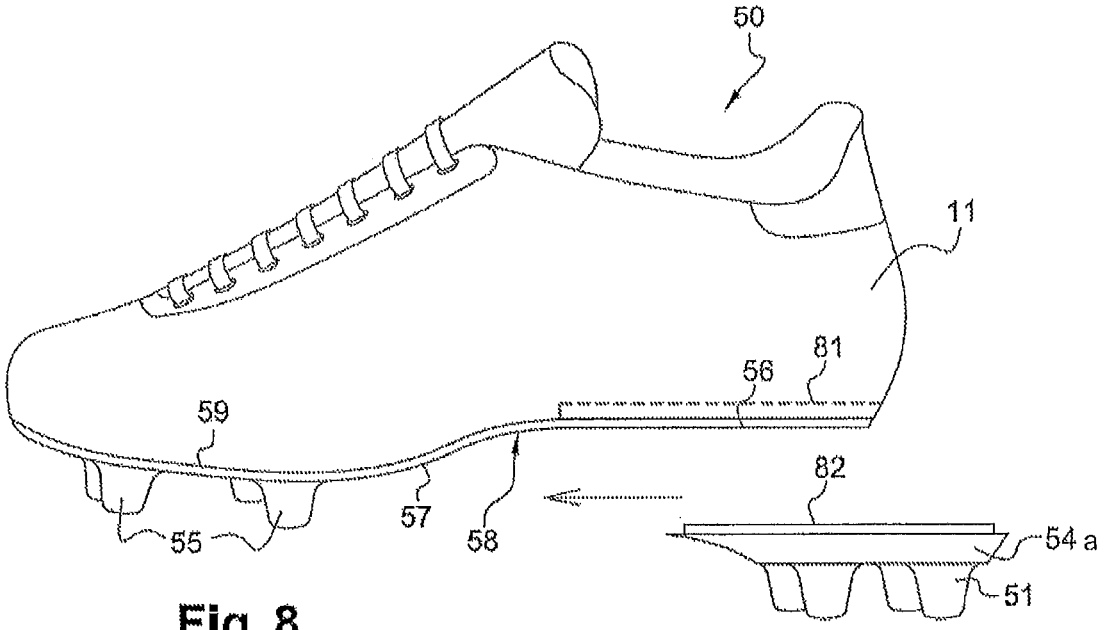
FIG. 8 represents an external side view of another variation of the second embodiment of a sports shoe with studs according to the invention.

FIG. 8 represents a variation of an embodiment of shoe 50 according to the second embodiment of the invention. In this variation, riser 54*a* comprises a projecting slider 82 (male portion) in its upper portion enabling riser 54*a* to be placed by longitudinal sliding in a hollow slider 81 (female portion) present in outer sole 1.

Figure 9:
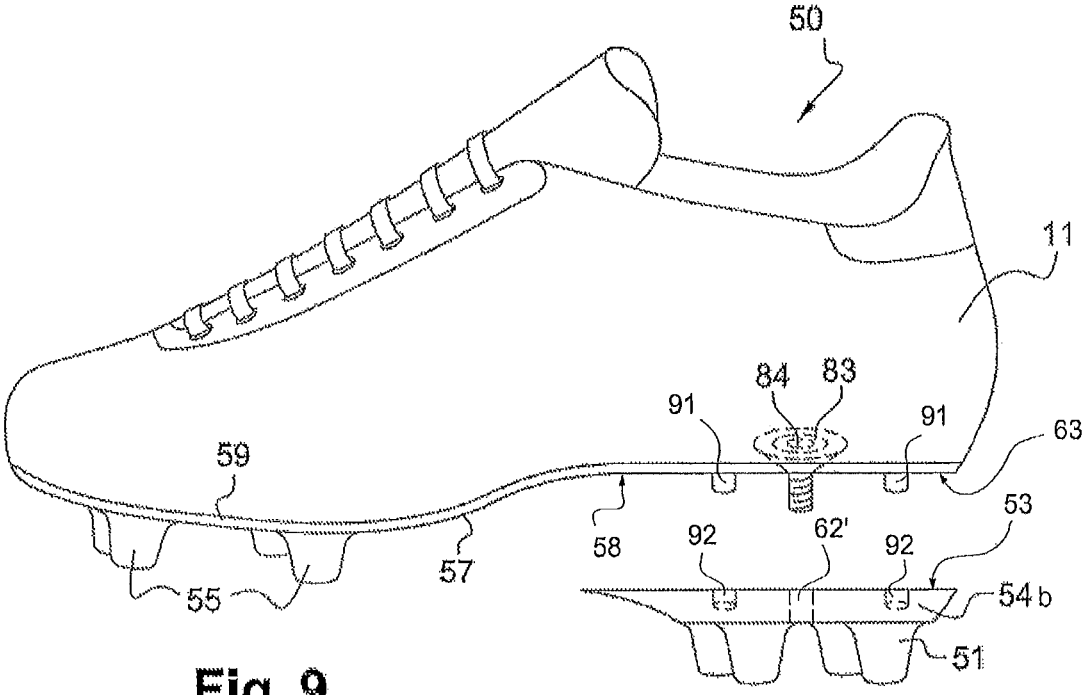
FIG. 9 represents an outer side view of another variation of the second embodiment of a sports shoe with studs according to the invention.

FIG. 9 represents another variation of embodiment of shoe 50 according to the second embodiment of the invention. In this variation, riser 54*b* comprises at the level of its upper surface 53 non-piercing cavities 92 as well as a bore 62'. The outer surface 63 of outer sole 58 comprises lugs 91 able to follow the shape of cavities 92 and able to be inserted into said cavities 92 when riser 54*b* is placed on shoe 50. Lugs 91 and cavities 92 enable a bearing surface or additional retention of riser 54*b* to be made and positioned. In this variation, riser 54*b* forms an integral connection on shoe 50 for example by means of a quarter screw 83 enabling the rapid screwing or unscrewing of riser 54*b* by means of a simple element that is able to be inserted into slot 84 of the quarter screw 83.

Figure 10:
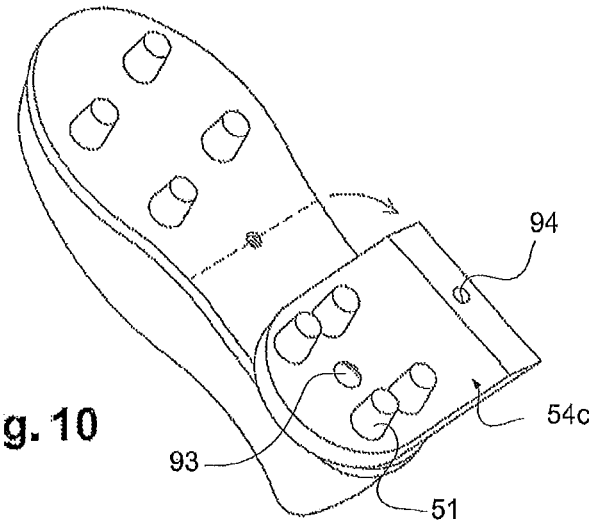
FIG. 10 represents a perspective view of the outer sole of another variation of the second embodiment of a sports shoe with studs according to the invention.

FIG. 10 represents another variation of embodiment of shoe 50 according to the second embodiment of the invention. In this variation, riser 54*c* is associated with the outer sole 58 by a quarter engaging system 93 with the socketing and rotation of riser 54*c*. Riser 54*c* also comprises fixation means 94 able to prevent unwanted rotation of riser 54*c* in order to secure it in a good position.

Figure 11:
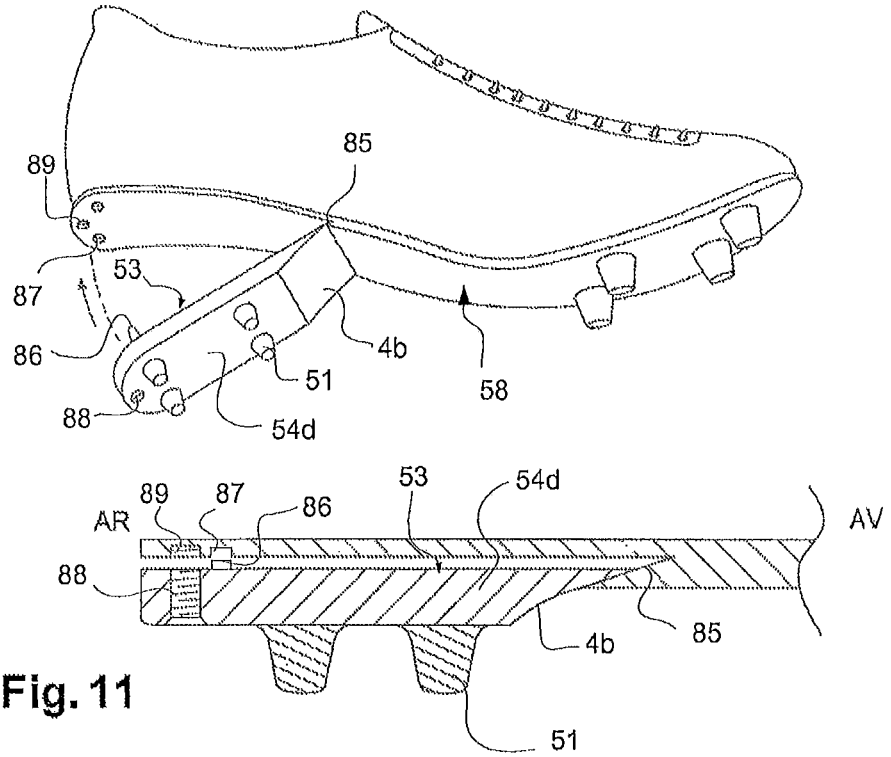
FIG. 11 represents an internal side view of another variation of the second embodiment of a sports shoe with studs according to the invention.

FIG. 11 represents another variation of embodiment of the shoe according to the invention. In this variation, front portion 4*b* of riser 54*d* is inserted into a notch 85 preconfigured in the outer sole 58 used as an anti-sliding stop. The upper surface 53 of riser 54*d* comprises retention lugs 86 able to be inserted into bores 87 of the outer sole 58 enabling riser 54*d* to be positioned onto sole 58.

Riser 54*d* is removably connected by screwing a screw 88 into a threaded bore 89 inside sole 58.

According to the variations described, posterior studs 51 may either be studs screwed into the outer sole 58 or studs screwed into riser 54*a*, 54*b*, 54*c*, 54*d* or studs molded directly onto riser 54*a*, 54*b*, 54*c*, 54*d*.

Figure 7:
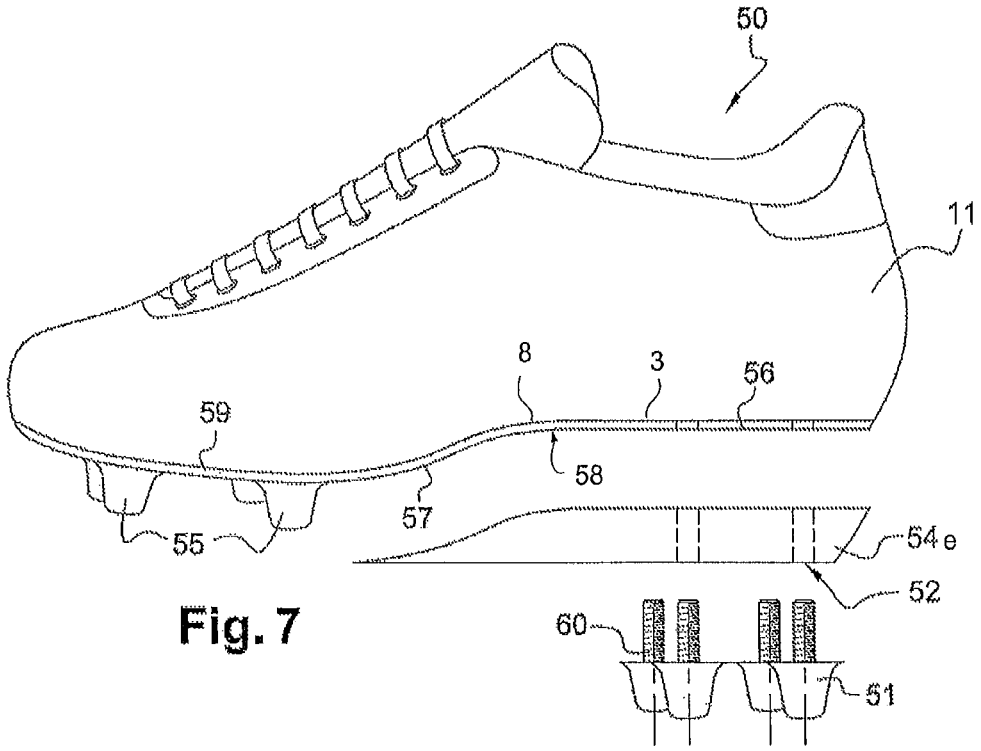
FIG. 7 represents an external side view of a variation of the second embodiment of a sports shoe with studs according to the invention.

According to another variation illustrated in FIG. 7, removable riser 54*e* provides a raising at the level of the rear portion 3 and at the level of the central portion 8 of outer sole 58.

Removable riser 54*e* may partially or fully cover central portion 8 of sole 58 (FIG. 7 illustrates the case where removable riser 54*e* fully covers central portion 8).

The portion of riser 54*e* situated in central portion 8 and the portion of riser 54*e* situated in rear portion 3 of sole 58 may be made with different types of materials contributing different qualities such as cushioning and stability qualities or the absorption of shock waves harmful to the integrity of cartilage or else the absorption of vibrations which generate various mechanical pathologies.

In this variation, riser 54*e* is removably connected onto outer sole 58 by an engaging means such as described in the previous figures.

The removable aspect of the riser has been particularly described with a sports shoe comprising an outer curved sole in its central portion, i.e., at the level of the mid-foot. However, it is also planned to be able to use a removable riser such as described in the present application on a sports shoe sole that does not comprise a curvature at the level of its central portion.

The removability of riser 54 enables the type of riser to be quickly and easily interchanged in view of contributing a new technical characteristic to the shoe and/or to modify the shoe, such as for example the modification of the riser height. Changing the height of the posterior raising, by the rapid interchangeability of riser 54, thus enables a changeable sports shoe 50 with studs to be proposed that can be adapted to various technical and anatomical requirements of the sports players.

Riser 54 may then comprise different visible outer markings in order to identify the different types of risers, such as for example a color code corresponding to different thicknesses. Riser 54 may also be made of different materials providing qualities in addition to the raising of shoe 50, such as for example cushioning and stability qualities, the absorption of shock waves harmful to the integrity of cartilage or else the absorption of vibrations which generate various functional pathologies in the sports player.

According to another variation of embodiment that is not represented, riser 54 is a "composite" riser, i.e., the riser comprises a plurality of layers, of low thickness, on the order of some millimeters, made by means of different materials comprising specific and different mechanical properties. Thus, riser 54 becomes an element that can be entirely and unlimitedly customized, adjusted and perfected, either regarding the thickness or the mechanical properties that it contributes to the sports shoe, thus enabling the criteria, expectations and needs of the sports player to be met as closely as possible.

The sports shoe according to the invention thus constitutes an elementary link in the prevention, protection and improvement of sports player performance.

The sports shoe also presents the following additional advantages:

- no modification in the volume of the existing instep, which leads to a low development cost and allows the use of the instep volume for adapting custom made plantar orthotics;
- preservation of the biomechanics of the lower limbs, pelvis and back;
- improvement and respect of the three arches and three supporting pillars of the foot;
- improvement in the effort venous system and improvement in plantar venous drainage and lower limb drainage;
- improvement in explosiveness on rapid races from a standing start;
- improved comfort;
- protection against and control of mechanical pain;
- improvement in toxin elimination;
- improved performance and muscle yield; and
- limited risk of injury.

It goes without saying that other modes of embodiment may be contemplated without departing from the scope of the invention, this in no way being limited to the examples described and represented.

In particular, although the modes of embodiment described previously apply to a soccer shoe, the invention may also relate to shoes provided for playing other sports such as rugby, American football, baseball or other sports.

The invention claimed is:

1. A sports shoe comprising:

an instep;

a rigid outer sole, said rigid outer sole having an external surface and presenting:

a front portion comprising a first plurality of studs extending from the external surface, the external surface of the rigid outer sole defining an outer surface of the sports shoe at said front portion;

a central portion; and a rear portion at a heel of the sports shoe, a second plurality of studs, and a thickened portion presenting a flat outer surface on which said second plurality of studs is located, said thickened portion raising the external surface of the rigid outer sole at said rear portion with relation to the external surface of the rigid outer sole at said front portion, said thickened portion being formed by a removable riser that is removably positioned on the external surface of the rigid outer sole at said rear portion, wherein said removable riser includes a flat upper face to be positioned in contact with and against the external surface of the rigid outer sole, a flat lower face defining said flat outer surface and a beveled portion extending from said flat lower face to said flat upper face to connect the flat lower face to the flat upper face at said central portion of the sport shoe, said beveled portion and said flat lower face forming at least part of an external surface of the removable riser, wherein said central portion has a convex and inwardly curved outer profile from the external surface of the sports shoe extending along a longitudinal direction of the sports shoe, the convex and inwardly curved outer profile being formed by a curved surface extending between the front portion and the rear portion and the beveled portion of the removable riser forming a part of said curved surface, wherein said central portion comprises a curved inner profile within the instep that is configured to follow a shape of a longitudinal arch of a foot placed into the sports shoe, and wherein said second plurality of studs are removable studs screwed into both said removable riser and said rear portion of the rigid outer sole.

2. The sports shoe according to claim 1, wherein said first plurality of studs are molded studs forming an integral connection with said rigid outer sole.

3. The sports shoe according to claim 1, wherein said thickened portion is between 1 and 25 mm.

4. The sports shoe according to claim 3, wherein said thickened portion is between 10 and 15 mm.

5. The sports shoe according to claim 1, wherein a curve of said curved inner profile of said central portion varies along the transverse axis of the shoe.

6. The sports shoe according to claim 5, wherein said curved inner profile of said central portion presents an internal profile and an external profile forming a transverse arch, said internal profile comprising greater arching than said external profile.

7. The sports shoe according to claim 1, wherein said central portion has an elastic portion configured to be deformed to cushion foot placed into the sports shoe.

8. The sports shoe according to claim 1, wherein each of said removable riser and said rear portion of the rigid outer sole comprise bores for receiving said second plurality of studs therein.

9. The sports shoe according to claim 8, wherein said second plurality of studs include rods that traverse bores of said removable riser and are placed inside said bores said rear portion of the rigid outer sole.

* * * * *